US010734169B2

(12) United States Patent
Lammers et al.

(10) Patent No.: US 10,734,169 B2
(45) Date of Patent: Aug. 4, 2020

(54) MECHANISM FOR OPENING AND CLOSING A CIRCUIT BREAKER

(71) Applicant: Eaton Intelligent Power Limited, Dublin (IE)

(72) Inventors: Arend Lammers, Hengelo (NL); Jinto Md, Pune (IN); Akshay Vatharkar, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/332,850

(22) PCT Filed: Sep. 14, 2017

(86) PCT No.: PCT/EP2017/073169
§ 371 (c)(1),
(2) Date: Mar. 13, 2019

(87) PCT Pub. No.: WO2018/050760
PCT Pub. Date: Mar. 22, 2018

(65) Prior Publication Data

US 2019/0221379 A1 Jul. 18, 2019

(30) Foreign Application Priority Data

Sep. 14, 2016 (IN) ..... 201611031325
Nov. 29, 2016 (GB) ..... 1620240.0

(51) Int. Cl.
*H01H 3/30* (2006.01)
*H01H 3/42* (2006.01)

(52) U.S. Cl.
CPC ..... *H01H 3/30* (2013.01); *H01H 3/42* (2013.01); *H01H 2003/3094* (2013.01)

(58) Field of Classification Search
CPC ..... H01H 3/30; H01H 3/42; H01H 2003/3094
USPC ..... 200/400
See application file for complete search history.

(56) References Cited

U.S. PATENT DOCUMENTS 5,107,715 A 4/1992 Thuries
5,772,009 A * 6/1998 Rogers ..... H01H 3/3047 200/400

FOREIGN PATENT DOCUMENTS

EP 0045546 A2 2/1982
EP 0294561 * 12/1988 ..... H01H 3/30
EP 0294561 A2 12/1988

* cited by examiner

*Primary Examiner* — Nguyen Tran
*Assistant Examiner* — Iman Malakooti
(74) *Attorney, Agent, or Firm* — Leydig, Voit & Mayer, Ltd.

(57) ABSTRACT

A mechanism for opening and closing a circuit breaker having an operating rod for moving contacts of the circuit breaker between an open position and a closed position includes: a frame; a first axle rotatably arranged in the frame; a cam arranged on the first axle, which cam operates the operating rod of the circuit breaker; a first gear arranged on the first axle for driving the cam; a second axle arranged rotatably in the frame and parallel to the first axle; a sector gear arranged on the second axle, the sector gear having at least one toothed sector and at least one toothless sector, the at least one toothed sector engaging the first gear upon rotation of the second axle; a spring element for rotatably urging the sector gear; and a lock for locking the rotation of the second axle.

7 Claims, 3 Drawing Sheets

MECHANISM FOR OPENING AND CLOSING A CIRCUIT BREAKER

CROSS-REFERENCE TO PRIOR APPLICATIONS

This application is a U.S. National Phase application under 35 U.S.C. § 371 of International Application No. PCT/EP2017/073169, filed on Sep. 14, 2017, and claims benefit to Indian Patent Application No. IN 201611031325, filed on Sep. 14, 2016, and British Patent Application No. GB 1620240.0, filed on Nov. 29, 2016. The International Application was published in English on Mar. 22, 2018 as WO 2018/050760 under PCT Article 21(2).

FIELD

The invention relates to a mechanism for opening and closing a circuit breaker having an operating rod for moving the contacts of the circuit breaker between an open position and a closed position.

BACKGROUND

For certain applications it is required that a circuit breaker, after detecting a fault, opens the contacts and then quickly closes the contacts. When the fault remains, the contacts can then be kept open for a longer duration. The first opening and closing of the contacts should be performed in less than a second, typically less than 0.3 seconds. If the fault remains, the contacts can then be opened again and closed after a longer duration, for example a minute. This is called in the art an open-close-open (OCO) cycle.

Due to space restrictions in the switch gear, wherein the circuit breakers are applied, it is not possible to provide an electric motor, sufficient strong and quick to open and close the contacts within a split second. So, a mechanism is required in which for example spring energy is used to provide the quick opening and closing of the contacts.

U.S. Pat. No. 5,107,715 discloses a mechanism with open-close-open cycle for a circuit breaker. The circuit breaker is connected with a shaft which comprises a first, spring loaded, lever. The shaft is furthermore coupled via a freewheel coupling to a second shaft part on which a second, spring loaded, lever is arranged. When a fault occurs, the first lever is released driving the circuit breaker in an open position. Then the second lever is released driving the shaft further, such that the circuit breaker re-closes and the first spring is reloaded again. As the first lever is still released, the reloaded first spring will drive the shaft yet again further, such that the circuit breaker opens again.

This mechanism is quite complex and is voluminous. Furthermore, the reloading of the first spring depends on the spring force of the second spring, which thus needs to provide both the force to operate the circuit breakers and the force to reload the first spring.

SUMMARY

In an embodiment, the present invention provides a mechanism for opening and closing a circuit breaker having an operating rod for moving contacts of the circuit breaker between an open position and a closed position, the mechanism comprising: a frame; a first axle rotatably arranged in the frame; a cam arranged on the first axle, which cam is configured to operate the operating rod of the circuit breaker; a first gear arranged on the first axle, the first gear being configured to drive the cam; a second axle arranged rotatably in the frame and parallel to the first axle; a sector gear arranged on the second axle, the sector gear having at least one toothed sector and at least one toothless sector, the at least one toothed sector being configured to engage the first gear upon rotation of the second axle; a spring configured to rotatably urge the sector gear; and a lock configured to lock the rotation of the second axle.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1B:
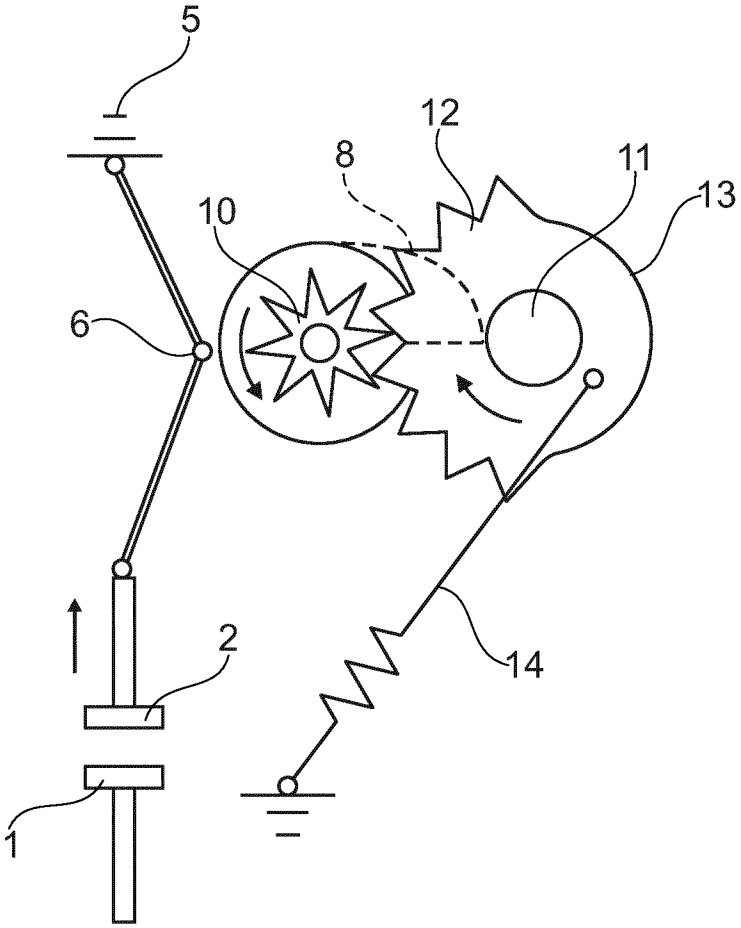
FIGS. 1A-1E show a schematic view of a first embodiment of the invention in five different positions.

In an embodiment the present invention to provide a mechanism, which reduces or even removes the above mentioned disadvantages.

In an embodiment, the present invention provides a mechanism comprising: a frame; a first axle rotatably arranged in the frame; a cam arranged on the first axle, which cam is arranged to operate the operating rod of the circuit breaker; a first gear arranged on the first axle to drive the cam; a second axle arranged rotatably in the frame and parallel to the first axle; a sector gear arranged on the second axle, wherein the sector gear has at least one toothed sector and at least one toothless sector, wherein the at least one toothed sector engages the first gear upon rotation of the second axle; spring means for rotatably urging the sector gear; and locking means for locking the rotation of the second axle.

With the sector gear it is possible to drive the cam via the first gear by the toothed sector over a defined path of rotation and then have the spring element further release the spring force by further rotating the sector gear, which is no longer engaged with the first gear and will therefore not be rotated further by the first gear. Due to the spring element the first gear will be driven fast, such that the contacts open and close quickly.

With the mechanism according to the invention the contacts can thus be opened and then closed by engagement of the toothed sector with the gear wheel and then the sector gear will be disengaged from the first gear, such that the first axle with the first gear and cam can be independently rotated to again open the contacts of the circuit breaker. Also the second axle with the sector gear can be independently rotated to energize the spring element.

In a preferred embodiment of the mechanism according to the invention the spring element comprises a tension spring, which tension spring is arranged with one end to the frame and with the other end to the sector gear offset from the center of rotation.

By having a tension spring attached offset from the center of rotation, the sector gear can be pulled by the tension spring over half of a full rotation. The other half of the full rotation can then be used to re-tension the spring. This ensures that the sector gear only needs to rotate in one direction.

With the embodiment it is preferred that the toothed section engages the first gear during the full first half of the full rotation, in which the tension spring pulls the sector gear.

In a further preferred embodiment of the mechanism according to the invention the number of teeth on the at least one toothed sector is at least equal to the number of teeth on the first gear.

In this embodiment half of a full rotation of the sector gear will be able to provide a full rotation of the first axle with the cam arranged thereon. This allows for a opening and closing of the contacts by only half of a full rotation of the sector gear.

In another embodiment of the invention two or more cams could be arranged to the first axle, such that for example only half or a third of a full rotation is required of the first axle to provide an open-close action of the contacts.

A further embodiment of the mechanism according to the invention further comprises a first driving element for rotatably driving the first axle.

With the first driving element the contacts can be operated to an open or closed position by rotating the cam on the first axle. The driving can be at a low speed as the spring element together with the sector gear provide for the quick opening and closing of the contacts.

Yet a further embodiment of the mechanism according to the invention further comprises a second driving element for rotatably driving the second axle in order to re-tension the spring element.

The invention also relates to a combination of a mechanism according to the invention and a circuit breaker comprising two contacts movable relative to each other between a closed position and an open position, and an operating rod arranged to at least one of the contacts for moving the at least one contact, wherein the cam of the mechanism is in contact with the operating rod to move the operating rod to open and close the contacts by rotation of the cam.

Preferably, the operating rod comprises at least two linked rods each rod having a single degree of freedom, wherein one free end of the linked rods is hingedly connected to the frame, wherein the other free end of the linked rods is hingedly connected to at least one of the contacts, and wherein the cam of the mechanism engages one of the linked rods in a direction substantially perpendicular to the longitudinal direction of said rod.

By using at least two linked rods, wherein the cam engages on one of the linked rods, a relative large force can be generated for operating the contacts, while the force generated by the cam can remain relatively small.

Figure 1A:
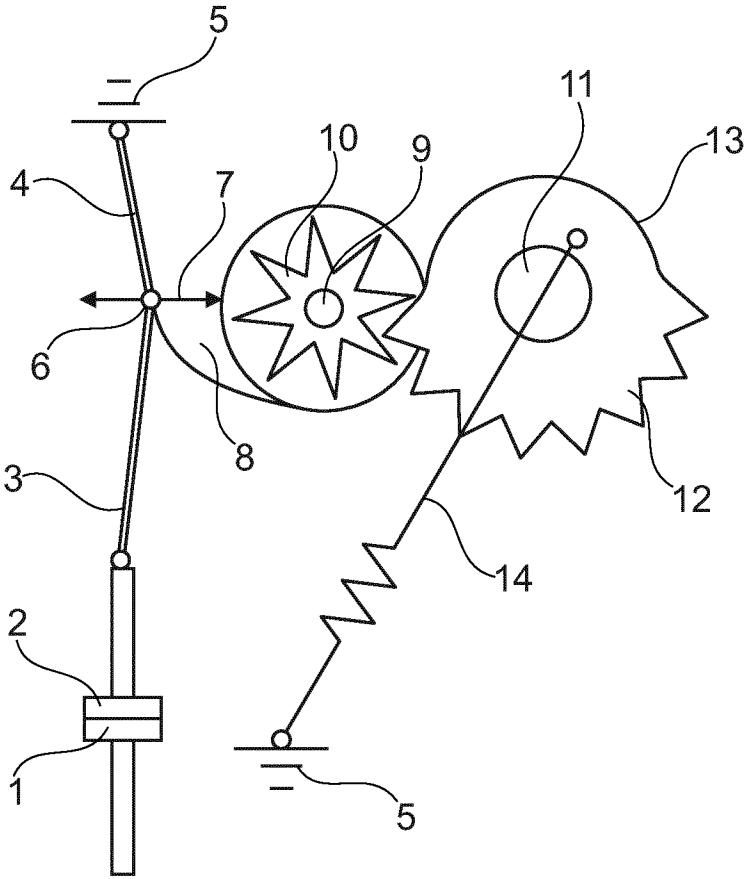

FIG. 1A shows a schematic view of a first embodiment of a mechanism according to the invention and a circuit breaker. The circuit breaker has a fixed contact 1 and a movable contact 2, which is connected to an operating rod 3, 4. The operating rod 3, 4 comprises two linked rods 3, 4. One end of the rod 3 is hingedly arranged to the movable contact 2, while another free end of the rod 4 is connected hingedly to a frame 5.

The rods 3, 4 are connected via a single degree of freedom hinge 6, which allows for a large force to be generated on the movable contact 2 with a small movement of the hinge 6 substantially perpendicular to the longitudinal direction of the rods 3, 4 (as shown in FIG. 1A by the double arrow 7.

The hinge 6 and therefore the circuit breaker 1, 2 is operated by a cam 8, which is arranged on a first axle 9. A first gear 10 is furthermore arranged on the first axle 9.

A second axle 11 is arranged parallel to the first axle 9. A sector gear 12, 13 is arranged on the second axle and has a toothed section 12 and a toothless section 13.

A tension spring 14 is furthermore arranged between the frame 5 and the sector gear 12, 13 offset from the center of the second axle 11. The second axle 11 is locked in the shown position to prevent the tension spring 14 from turning the sector gear 12, 13.

FIG. 1B shows when the lock of the second axle 11 is released and the sector gear 12, 13 has been already rotated over a quarter of a full revolution. The toothed sector 12 engages on the first gear 10, such that cam 8 turns away from the hinge 6 and allows for the circuit breaker 1, 2 to open.

The number of teeth of the first gear 10 is equal to the number of teeth of the toothed section 12, such that with the quarter revolution of the sector gear 12, 13, the first gear 10, and accordingly the cam 8, makes half of a full revolution.

Figure 1D:
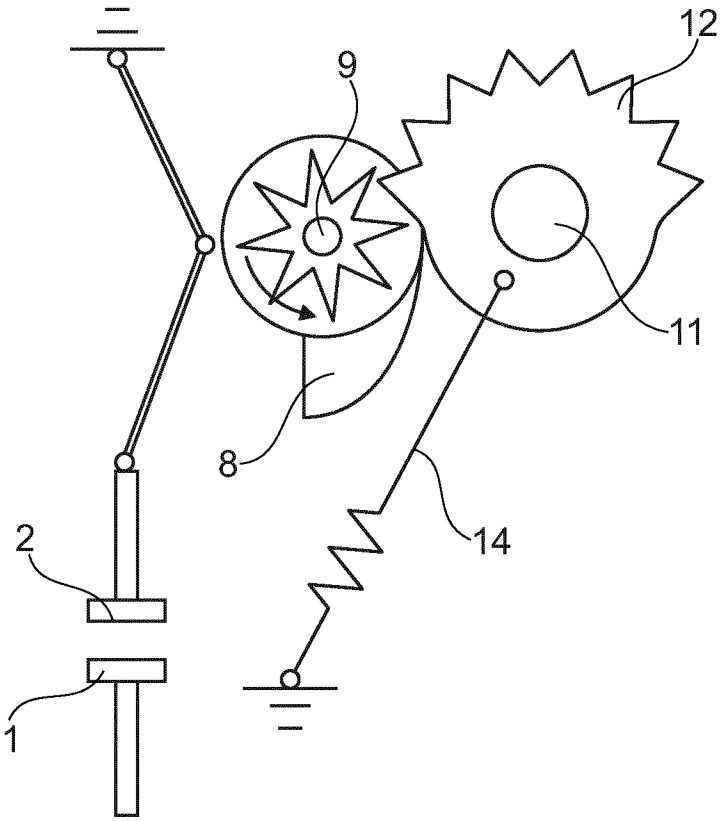
Figure 1C:
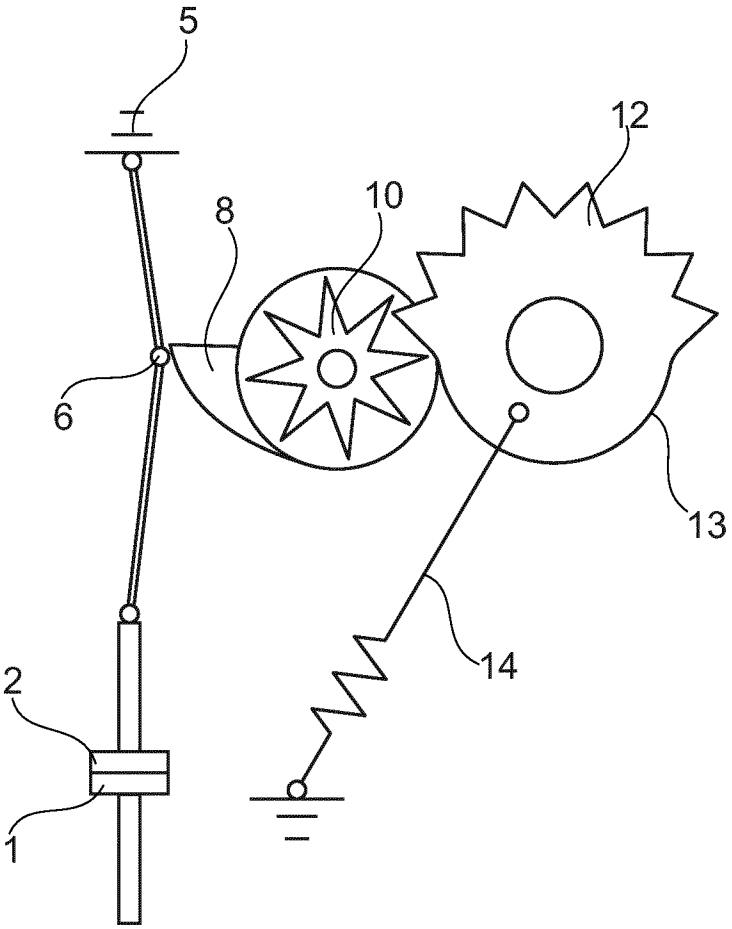

As the spring 14 is still releasing spring force on the sector gear 12, 13, the sector gear continues to rotate to half of a full revolution, as shown in FIG. 1C. The toothed sector 12 will then have urged the first gear 10 through a full revolution, such that the cam 8 again is in contact with the hinge 6 and the circuit breaker 1, 2 is again in the closed position.

The spring force of the spring 14 is now fully released and the toothed section 12 is turned out of engagement with the first gear 10.

As shown in FIG. 1D, this allows for the first axle 9 to be rotated independently from the second axle 11. With drive means it is then possible to open the contacts 1, 2 of the circuit breaker again.

Figure 1E:
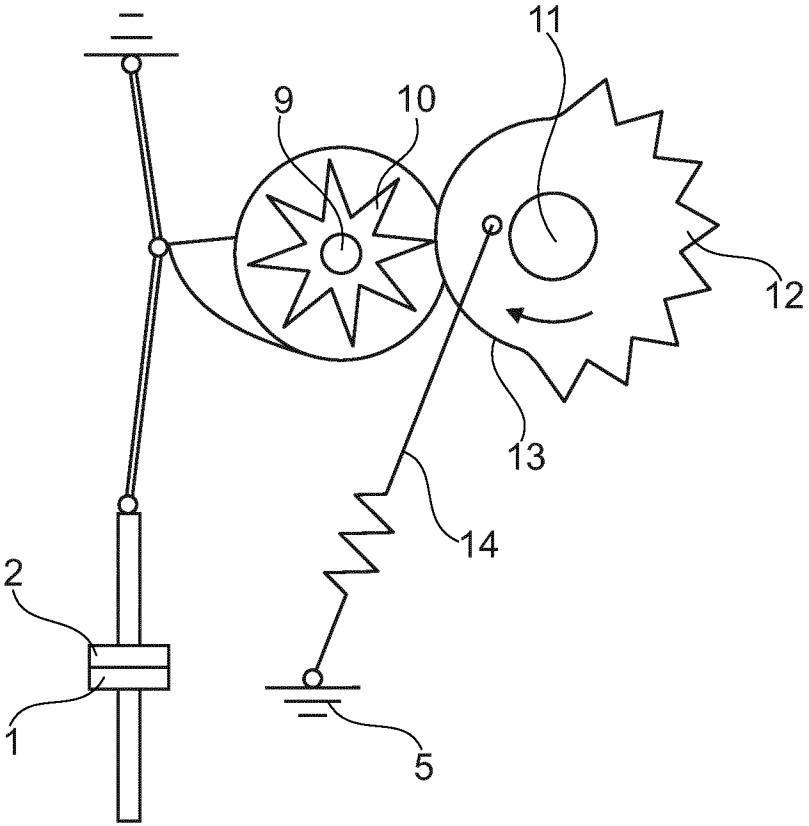

Furthermore, as shown in FIG. 1E, the second axle 11 can be rotated independently of the first axle 9 as long as the toothless section 13 is directed to the first gear 10. This allows for half of a full revolution of the second axle 11, such that the tension spring 14 can be re-tensioned again, such that the mechanism is brought into the same position as shown in FIG. 1A.

Figure 2:
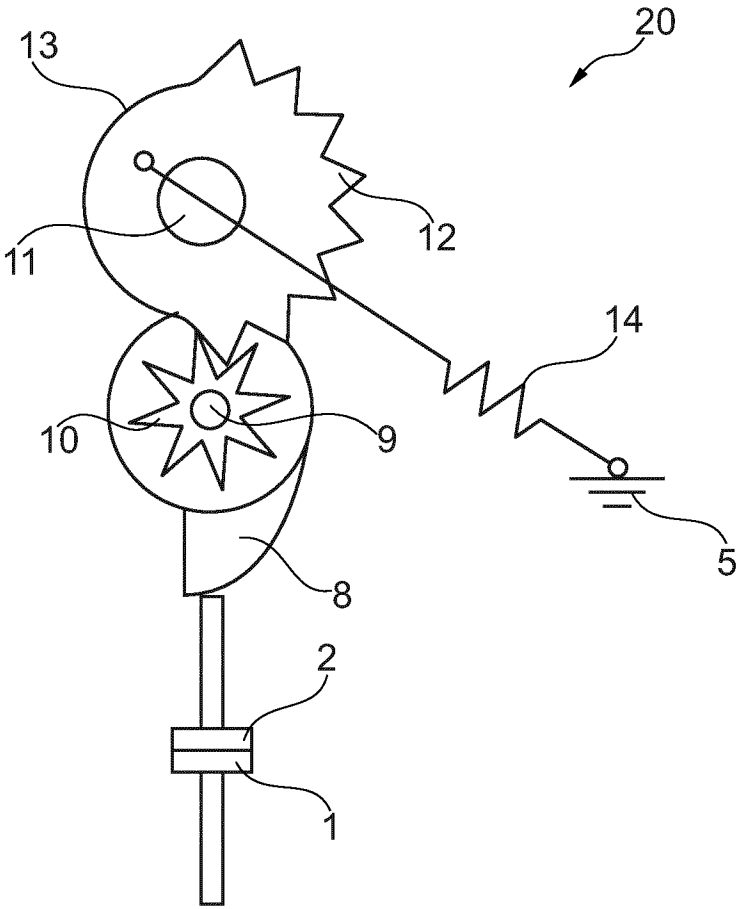
FIG. 2 shows a schematic view of a second embodiment of the invention.

FIG. 2 shows a second embodiment 20 in which the same mechanism as shown in FIGS. 1A-1E is used. The cam 8 is in this embodiment in direct contact with the movable contact 2 of the circuit breaker 1, 2. Due to the direct contact of the cam 8 with the circuit breaker 1, 2 a higher operating force needs to be generated, but the additional linked rods 3, 4, as used in the first embodiment could be discarded.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A mechanism for opening and closing a circuit breaker having an operating rod for moving contacts of the circuit breaker between an open position and a closed position, the mechanism comprising:

a frame;

a first axle rotatably arranged in the frame;

a cam arranged on the first axle, which cam is configured to operate the operating rod of the circuit breaker;

a first gear arranged on the first axle, the first gear being configured to drive the cam;

a second axle arranged rotatably in the frame and parallel to the first axle;

a sector gear arranged on the second axle, the sector gear having at least one toothed sector and at least one toothless sector, the at least one toothed sector being configured to engage the first gear upon rotation of the second axle;

a spring configured to rotatably urge the sector gear; and a lock configured to lock the rotation of the second axle.

2. The mechanism according to claim 1, wherein the spring comprises a tension spring, which tension spring is arranged with one end to the frame and with an other end to the sector gear offset from a center of rotation.

3. The mechanism according to claim 1, wherein a number of teeth on the at least one toothed sector is at least equal to a number of teeth on the first gear.

4. The mechanism according to claim 1, further comprising a first driver configured to rotatably drive the first axle.

5. The mechanism according to claim 1, further comprising a second driver configured to rotatably drive the second axle to re-tension the spring element.

6. A combination, comprising:

the mechanism according to claim 1; and the circuit breaker comprising two contacts movable relative to each other between the closed position and the open position, and the operating rod arranged to at least one of the two contacts for moving the at least one of the two contacts, wherein the cam of the mechanism is in contact with the operating rod so as to move the operating rod to open and close the two contacts by rotation of the cam.

7. A combination, comprising:

a circuit breaker, comprising:

two contacts movable relative to each other between a closed position and an open position; and an operating rod arranged to at least one of the two contacts for moving the at least one of the two contacts; and a mechanism for opening and closing the circuit breaker between the open position and the closed position, the mechanism comprising:

a frame;

a first axle rotatably arranged in the frame;

a cam arranged on the first axle, which cam is configured to operate the operating rod of the circuit breaker;

a first gear arranged on the first axle, the first gear being configured to drive the cam;

a second axle arranged rotatably in the frame and parallel to the first axle;

a sector gear arranged on the second axle, the sector gear having at least one toothed sector and at least one toothless sector, the at least one toothed sector being configured to engage the first gear upon rotation of the second axle;

a spring configured to rotatably urge the sector gear; and a lock configured to lock the rotation of the second axle, wherein the cam of the mechanism is in contact with the operating rod so as to move the operating rod to open and close the two contacts by rotation of the cam, wherein the operating rod comprises at least two linked rods, each rod having a single degree of freedom, wherein one free end of the linked rods is hingedly connected to the frame, wherein an other free end of the linked rods is hingedly connected to at least one of the two contacts, and wherein the cam of the mechanism engages one of the linked rods in a direction substantially perpendicular to a longitudinal direction of the rod.

* * * * *